United States Patent [19]

Ugata et al.

[11] 3,996,991

[45] Dec. 14, 1976

[54] INVESTMENT CASTING METHOD

[75] Inventors: Ken Ugata, Nara; Yasuji Morita, Kobe; Yasuharu Mine, Osaka, all of Japan

[73] Assignee: Kubota, Ltd., Osaka, Japan

[22] Filed: Nov. 6, 1974

[21] Appl. No.: 521,533

[30] Foreign Application Priority Data

Nov. 13, 1973 Japan ..... 48-127850
Mar. 19, 1974 Japan ..... 49-31881

[52] U.S. Cl. ..... 164/35; 164/131; 164/349

[51] Int. Cl.[2] ..... B22C 09/04

[58] Field of Search ..... 164/34, 35, 36, 45, 164/235, 246, 132, 131, 349

[56] References Cited

UNITED STATES PATENTS 3,351,123 11/1967 Payne ..... 164/235 X
3,639,507 2/1972 Uram ..... 164/36 X

FOREIGN PATENTS OR APPLICATIONS 520,364 1/1956 Canada ..... 164/36
722,884 2/1955 United Kingdom ..... 164/36

*Primary Examiner*—Ronald J. Shore
*Attorney, Agent, or Firm*—Wenderoth, Lind & Ponack

[57] ABSTRACT

An investment casting method for making a desired casting of a relatively large size by the use of a mold of one-piece construction within close dimensions, which comprises preparing a thermally fusible pattern which is a replica of the desired casting, forming a refractory investment enveloping the thermally fusible pattern, melting the thermally fusible pattern out of the investment leaving a cavity in the refractory investment, and heating the investment to provide a rigid ceramic mold of one-piece construction. Melting of the thermally fusible pattern out of the investment is carried out in contact with a vaporized organic solvent without causing the thermally fusible pattern to thermally expand which may otherwise result in formation of cracks in the refractory, investment, that is, mold.

17 Claims, 5 Drawing Figures

INVESTMENT CASTING METHOD

The present invention relates in general to a precision casting method and, more particularly, to an investment casting method.

As is well known to those skilled in the art, the investment casting method is often called a lost-wax casting method (or a 'cire perdue' casting method), which some hundred years ago was primarily used by artisans in making sculptures, jewelry settings and other metalwork for decorative purposes. As the demand for precisely cast machine parts have increased with recent technological development, the lost-wax casting method has been revived and its improved version has heretofore been practised in the metallurgical field and, particularly, in manufacturing aircraft engine parts, because of precision casting it can afford. Along therewith, not only a wax, but also some other materials, either natural or synthetic, which can be liquefied or destroyed by heat, have become available as material for a pattern or model used during performance of this casting method to make a mold of one-piece construction by melting it away from the mold leaving a cavity having all the details of the pattern or model.

Because of a diversity of materials available for the pattern or model, it appears that the notation of investment casting has recently dominated at least in the metallurgical field rather than the notation of lost-wax casting. However, it should be understood that these notations are convertible with each other so far as the material for the pattern or model is not limited to wax.

In any event, the investment casting method generally comprises preparing a thermally fusible pattern from a thermally fusible material, for example, polystyrene and wax, with or without the use of the master pattern which is a replica of a desired casting, subsequently forming a refractory coating or investment enveloping the thermally fusible material, and heating in an oven the thermally fusible pattern with the refractory coating to melt the pattern out of the refractory coating thereby rendering the latter to provide a mold of one-piece construction leaving the cavity having all the details of the original pattern. The mold thus constructed is thereafter heated to strength it while backed-up by back-up material, for example, dry sand, filled in a flask and, subsequently, molten metal is poured under pressure into the cavity of the mold. Upon solidification of the molten metal within the mold, the desired casting can be obtained by breaking the mold enveloping the solidified metal.

In this investment casting method, partly because of the mold of one-piece construction and partly because of the employment of the thermally fusible material for the pattern necessary to make the mold, it has been considered a convenient and effective method for precision casting and, in practice, is used primarily in the manufacture of aircraft engine parts. However, according to the prior art, material for the pattern cannot afford to provide a mold necessary to manufacture a relatively large casting and, even if it can, the resultant mold cannot have a sufficient physical strength to such an extent as to withstand the pressure exerted by molten metal poured under pressure into the mold cavity. Consequently, the conventionally practised investment casting method is limited to the production of relatively small castings.

For the manufacture of relatively large castings such as individual turbine blades, each being 40 to 130 cm. in length and 1 to 70 kg. in weight, for an electric power generating turbine or a screw propeller, about 130 cm. in outer diameter and 150 kg. in weight, for a vessel, the prior art is the use of a green sand molding technique or a ceramic shell molding technique or shaw process. A common feature of these techniques resides in the use of a mold composed of a pair of mold halves which are clamped together during actual casting of metal. Because of the mold halves having respective split faces which contact to each other when they are clamped together for metal pouring, precision casting is often hampered. By way of example, formation of a fin or flash at a portion of the resultant casting which is registered with the joint between the mold halves cannot be avoided without difficulty. Accordingly, the resultant casting has to be subjected to a grinding or machining process not only to remove the fin or flash, but also to make the resultant casting to meet the desired dimensions precisely. The prior art being such as hereinbefore described, casting of stainless steel with the conventional technique, which stainless steel is generally considered as having a relatively low workability or processability and which is relatively expensive material, would result in waste of the stainless steel or, otherwise, require a lot of skills to minimize the waste thereof.

More particularly, it is well recognized that manufacture of a vessel screw propeller requires a precision casting to a predetermined dimensions because each propeller blade has a varying thickness over the length thereof and also over the width thereof from the standpoint of hydrodynamics. Where such a vessel screw propeller is manufactured by the use of the conventional green sand mold, employing as a metallic material therefor stainless steel which may be substituted for a copper alloy due to its relatively high resistances to corrosion and wear and its relatively high mechanical strength, it has often experienced that sand sintering, misrun of the metal into the mold cavity and/or formation of gas defects such as blowholes tend to occur because the sand mold can only be heated to a limited temperature and, accordingly, has a relatively low resistance to fire. In addition to the aove disadvantages, since the casting within close dimensions can hardly be obtained with the conventional sand molding technique, the casting should be manufactured making allowances for reduction of the size thereof which may be effected during the subsequent grinding or machining process. This in turn leads to waste of material for the casting and to increase of the manufacturing cost thereof.

A similar description as set forth above can equally be applicable to the manufacture of blades, which are used in both a turbine and a compressor forming a supercharger or use in association with a vessel engine or with an aircraft engine, and other castings which should be manufactured within close dimensions.

Considering again the conventional investment casting method, because of the nature of the material for the pattern or model, preparation of the pattern or model requires the employment of a relatively large, complicated injection molding machine for injecting the thermally fusible resinous material. Unless the thermally fusible pattern or model is prepared by hand-molding such as commonly practised by artisans in making sculptures, preparation of the pattern or mold on the industrial scale is carried out by the use of a master pattern on the basis of which a metal-alloy split mold is subsequently cast. This split mold is properly finished and gated and is then ready for use in forming the thermally fusible pattern or model. During the formation of the split mold, the material for the thermally fusible pattern or model has to be injected into a cavity of the split mold by the use of the injection molding machine. The employment of the injection machine leads to increase of the manufacturing cost. This is partly because the split mold has to be made so rigid that it can withstand the fluid pressure of the thermally fusible material being injected into the mold cavity and partly because, where a desired casting has a hollow in the body of the desired casting and, for this purpose, a core or mandrel has to be installed in the mold cavity, care should be taken to avoid any possible displacement of the core from a preplanned position within the mold cavity, which displacement may otherwise take place by the effect of the fluid pressure exerted by the injection molding machine. It is to be noted that this complicated procedure of accurately positioning the core within the split mold cavity often constitute a cause of delay in delivery of the product to a customer.

Accordingly, an essential object of the present invention is to provide an improved investment casting method which substantially eliminates the disadvantages and inconveniences inherent in the prior art precision casting methods.

Another object of the present invention is to provide an improved investment casting method of the type referred to above, which can advantageously be employed in the manufacture of a relatively large, precisely finished castng, without substantially requiring any complicated casting procedures.

A further object of the present invention is to provide an improved investment casting method of the type referred to above, which can advantageously be practised for precisely manufacturing a desired casting at reduced costs and without substantially delaying the time limit for delivery to the customer.

According to the present invention, an essential feature resides in the employment of a vaporizable solvent having large specific gravity over air the vapor of which is used to melt the thermally fusible pattern thereby leaving a refractory coating or investment. The refractory coating or investment becomes a rigid mold ready for use in actual casting, after said investment has been heated to strengthen it.

In any event, these and other objects and features of the present invention will readily become apparent from the followng description taken in conjunction with a preferred embodiment thereof with reference to the accompanying drawings, in which.

Figure 1:
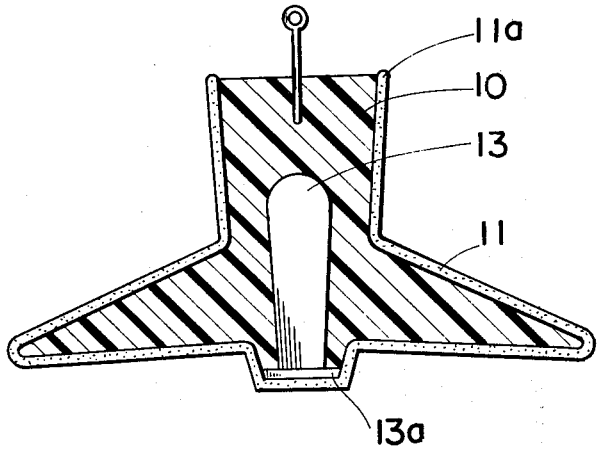
FIG. 1 is a side sectional view of a thermally fusible pattern, similar in shape to a vessel screw propeller, after having been invested with a refractory coating.

Before the description of the present invention proceeds, it should be noted that like parts are designated by like reference numerals throughout the accompanying drawings. In addition, it is also to be noted that, for the sake of facilitation of a better understanding of the present invention, the present invention will now be described as practised in manufacturing a vessel screw propeller.

Referring now to FIG. 1, a thermally fusible pattern 10 is shown as having a shape similar to a vessel screw propeller to be cast by the method of the present invention as is invested or covered with a refractory coating of a suitable wall thickness made of ceramic material, which refractory coating is designated by 11 and is to be understood that it provides a mold of one-piece construction at the time of completion of the investment casting according to the present invention, which mold is ready for use in casting of the vessel screw propeller.

Preparation of the thermally fusible pattern 10 may be carried out in any known manner and in a similar manner as practised in the conventional investment casting method. However, according to the present invention, it may be prepared by will become clear from the subsequent description, though the master of a split mold, composed of a pair of mold halves and made of plaster of Paris, which split mold has a female mold cavity having all the detailes of a master pattern (not shown) of the screw propeller.

As is well known to those skilled in the art, the screw properller has a bore through which said screw propeller is mounted on an engine drive shaft for rotation together with said drive shaft. By the reason which will master pattern is a replica of the screw propeller to be cast, it may not be provided with a recess which functionally and structurally corresponds to the bore in the screw propeller.

Prior to pouring a thermally fusible material for the pattern 10 into the cavity of the split mold composed of the pair of mold halves clamped together, a core 13, which finally defines the bore in the screw propeller, is placed at a predetermined position within the cavity of the split mold.

Subsequently, the thermally fusible material of fluid consistency, the composition of which will be described later, is poured into the cavity of the split mold. Because of the nature of the thermally fusible material herein used, pouring of the thermally fusible material into the cavity of the split mold does not require the use of an injection molding machine of the type referred to hereinbefore. This does not always mean that the use of the injection molding machine is excluded, but means that a relatively simple injection molding machine may be employed as desired even though a relatively large casting is to be manufactured.

Thereafter, the split mold with the thermally fusible material poured into the cavity is allowed to stand until the thermally fusible material solidifies. At the time of solidification of the thermally fusible material, the thermally fusible pattern 10 can be obtained by removing it from the split mold. It is to be noted that the thermally fusible pattern 10 thus obtained carries the core 13.

As the thermally fusible material for the pattern 10, one of naphthalene, naphthalene added with one or more of polystyrene resin, polyethylene resin, vinyl acetate and an ethylene-vinyl acetate copolymer, and p-dichlorobenzen added with one or more of polystyrene resin and vinyl acetate, may be employed. However, naphthalene added with the polystyrene resin in an amount within the range of 0.5 to 10% relative to the total weight of the naphthalene, naphthalene added with the ethylene-vinyl acetate copolymer in an amount within the range of 1 to 5% relative to the total weight of the naphthalene and naphthalene added with the polyethylene resin in an amount within the range of 3 to 10% relative to the total weight of the naphthalene are preferred.

The properties of the naphthalene and the naphthalene with or without each of the polystyrene resin, ethylene-vinyl acetate copolymer and polyethyrene resin are tabulated below.

Table I

| Types of Material | Amount Added (%) | Melting Point (° C) | (*)Amount of Shrinkage | Thermal Expansion Coefficient (× $10^{-6}$/° C) | (*)Deflective Strength (kg/cm²) |
|---|---|---|---|---|---|
| Naphthalene | — | 80.2 | 2.3/1,000 | 86.5 | 6.8 |
| Naphthalene plus Polystyrene resin | 0.5 | 80.0 | 2.6/1,000 | 87.4 | 20.8 |
| | 1.0 | " | 4.0/1,000 | 102.2 | 25.5 |
| | 3.0 | " | 5.0/1,000 | 155.5 | 31.0 |
| | 5.0 | " | " | 271.0 | 34.0 |
| | 10.0 | " | 7.3/1,000 | 349.6 | 37.4 |
| Naphthalene plus Ethylene-vinyl acetate copolymer | 1.0 | " | 3.0/1,000 | | 19.8 |
| | 3.0 | " | 6.0/1,000 | | 25.9 |
| | 5.0 | " | 10.0/1,000 | | 21.8 |
| Naphthalene plus Polyethylene resin | 3.0 | " | 8.5/1,000 | | 15.9 |
| | 5.0 | " | 11.0/1,000 | | 21.6 |
| | 10.0 | " | 16.0/1,000 | | 26.0 |

(*)Measured at the time the pattern 10 is formed.

After the thermal fusible pattern 10 has completed, the thermally fusible pattern 10 is repeatedly alternately subject to a coating process and a sanding process for a predetermined number of times to form a refractory investment 11 of a suitable wall thickness enveloping the thermally fusible pattern 10. By way of example, a cycle of the alternate coating and sanding processes is repeated 6 or 7 times in case of the desired screw propeller of 400 mm. in diameter and 10 to 12 times in case of the desired screw propeller of 1,200 mm. in diameter.

Each of the coating processes is carried out under the atmosphere where the temperature and the humidity are respectively maintained at 30°±1° C. and 40 to 50% in such a way as to dip the thermally fusible pattern 10 into a bath containing a slurry of refractory material, such as fused silica, zircon flour or alumina flour, which is chemically bonded by a binder, such as colloidal silica or hydrolysate of ethyl silicate. Preferably, during the first coating process, it is recommended to use the slurry containing zircon flour in an amount of 6.0 kg. per binder of 1 kg. as the refractory material, not less than 70% of which zircon flour has a particle size of 300 meshes, colloidal silicas type-A and type-B both in an amount of 0.5 lits as the binder and a surface active agent in an amount of 2 g. The surface active agent is preferably of a type commercially available under the trademark "NEOPELEX" manufactured and sold by Kao Atlas Co., Ltd. On the other hand, during the other coating processes than the first one, it is recommended to use the slurry containing zircon flour in an amount of 5.5 kg. as the refractory material, not less than 70% of which zircon flour has a particle size of 300 meshes and colloidal silicas type-A and type-B both in an amount of 0.5 lits. as the binder.

Alternatively, it may be possible to use, during the fist coating process, the slurry containing fused silica in an amount of 2.1 kg. as the refractory material, not less than 70% of which fused silica has a particle size of 325 meshes, colloidal silicas type-A and type-B both in an amount of 0.5 lits. as the binder and a surface active agent in an amount of 2 g., said surface active agent being of the type sold under the trademark NEOPELEX, and on the other hand, to use, during the other coating processes than the first coating process, the slurry containing fused silica in an amount of 1.5 kg. as the refractory material, not less than 70% of which fused silica has a particle size of 325 meshes and colloidal silicas type-A and type-B both in an amount of 0.5 lits. as the binder.

It should be noted that the colloidal silica type-A has a particle size of approximately 30 $\mu$ while the colloidal silica type-B has a particle size of approximately 10 $\mu$.

Each of the sanding processes is carried out in a fluidized bed of dry sand such as alumina sand or fused silica or by blasting or showering the dry sand to the investment 11, to strength the latter. During the first sanding process to be carried out subsequent to the first coating process, it is recommended to use the alumina sand having a particle size within the range of 20 to 100 meshes if the slurry used during the coating process contains the zircon flour as the refractory material or the fused silica having a particle size within the range of 20 to 100 meshes if the slurry used during the coating process contains the fused silica as the refractory material. Preferably, during the first sanding process to be carried out subsequent to the first coating process, the alumina sand or fused silica having a particle size within the range of 50 to 100 meshes is employed while during the other sanding processes than the first sanding process, the alumina sand or fused silica having a particle size within the range of 20 to 50 meshes is employed.

It should be noted that there may be a time span within the range of 30 to 60 seconds between one coating process and the following sanding process. In addition, there should be a time span, for example, within the range of 30 to 60 minutes, between one cycle of the coating and sanding processes and the following cycle in order to allow the investment 11 to dry.

At the time of completion of the repeated cycles of the alternate coating and sanding processes, it will readily be understood that the core 13 carried by the thermally fusible pattern 10 is mechanically interlocked as at 13a with the investment 11 so firmly that it will not separate from said investment 11 when and after the thermally fusible pattern 10 has been melted out in such a manner as will now be described.

After the last cycle of the coating and sanding processes has completed, the thermally fusible pattern 10 invested with the refractory coating 11 is completely melted out to provide the ceramic mold of one-piece construction of which the cavity has all the details of the original pattern of the screw propeller to be cast. In order to achieve this, a melting vessel of a construction as shown in FIG. 2 is employed.

Figure 2:
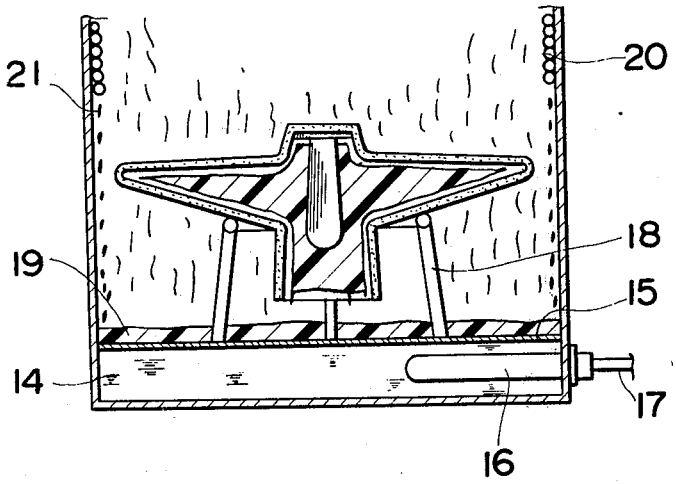
FIG. 2 is a side sectional view of the thermally fusible pattern being melted within a heating tank to provide a mold of one-piece construction for casting of a vessel screw propeller.

Referring to FIG. 2, the melting vessel has a bottom chamber 14 situated below a partition plate 15 and filled with fluid medium, for example, oil. The fluid medium within the bottom chamber 14 is adapted to be heated by a closed heating tube 16 which receives through a wiring 17 an electric power necessary to energize said heating tube 16. It is clear that upon energization of the heating tube 16, the fluid medium within the bottom chamber 14 is heated which in turn heats the partion plate 15.

The thermally fusible pattern 10 enveloped with the refractory investment 11 is placed within the melting vessel by the aid of a support stand 18 in such a manner that a portion of the pattern 10 which has not invested with the refractory coating 11, that is, the opening 11a of the refractory coating 11, substantially faces towards the partition plate 15 such that all the thermally fusible material constituting the pattern 10 can flow onto the partition plate 15. After or before placement of the thermally fusible pattern 10 in the melting vessel, an organic solvent, which comprises a solution of chlorinated hydrocarbon or alkane such as 1,1,1-trichloroethane ($CH_3 \cdot CCl_3$), 1,1,2-trichloroethane ($CHCl{:}CCl_2$) or 1,1,2,2-tetrachloroethane ($Cl_2C{:}CCl_2$), is poured into the melting vessel in a suitable amount determined in consideration of the amount of the thermally fusible material to be melted.

Physical properties of each of the solvents which can be used in the present invention are tabulated in the following table II.

Table II

| Types of Solvents | Molecular Weight | Boiling Point (° C.) | Specific Heat at 2° C | Specific Gravity at 4° C | Vapour Density (g/lit) | Specific Gravity Relative to Air | Vapour Pressure (mmHg) |
|---|---|---|---|---|---|---|---|
| $CH_3 \cdot CCl_3$ | 133.41 | 74.0 | 0.255 | 1.346 | 4.69 | 4.55 | 100.0 |
| $CHCl : CCl_2$ | 131.39 | 87.1 | 0.227 | 1.464 | 4.45 | 4.54 | 57.8 |
| $Cl_2C : CCl_2$ | 165.83 | 121.2 | 0.205 | 1.623 | 5.13 | 5.72 | 14.4 |

Upon generation of vapor of the solvent resulting from heating the latter, the thermally fusible pattern 10 begins to melt not only by the physical effect of latent heat of the vaporized solvent, but also by the chemical effect of the solvent vaporized. Preferably, the thermally fusible pattern 10 is placed within the melting vessel after the vapor of the solvent has been generated.

During the melting process, the vaporized solvent penetrates through the refractory coating 11, which substantially represents a porous structure, and at the same time, the refractory coating 11 is heated by the latent heat of the solvent thus vaporized. Therefore, the thermally fusbile pattern invested with the refractory coating 11 melts and the melting thereof completes, for example, in about 15 minutes in the case of the screw propeller of 400 mm. in diameter and in about 30 minutes in the case of the screw propeller of 1,200 mm. in diameter, thereby leaving a void in the refractory coating 11 while the melted thermally fusible material, that has constituted the thermally fusible material 11, is collected on the partition plate 15 within the melting vessel such as indicated by 19.

It is to be noted that, since the thermally fusible material for the pattern 10 is, as shown in Table I, of a type having a relatively small thermal expansion coefficient, the pattern 10 can readily be melted out without substantially causing the refractory coating 11 to have any cracks.

Alternatively, prior to the complete melting of the thermally fusible pattern 10 and after a certain amount of the thermally fusible material for the pattern 10 has completely melted leaving a clearance of a few milimeters between the surface of the pattern 10 and the inner surface of the refractory coating 11, the assembly may be removed out of the melting vessel and then placed in an oven to heat the assembly until the pattern 10 completely melts. This alternative method will be described later with reference to FIGS. 3 to 5.

Referring still to FIG. 2, in order to avoid waste of the organic solvent and to minimize contamination of the ambient air which may otherwise result from the solvent vaporized in the melting vessel, a condensing unit is provided in the melting vessel. In the example as shown, the condensing unit is employed in the form of a coiled cooling pipe mounted as at 20 to the melting vessel adjacent the opening at the top thereof. The coiled cooling pipe 20 is connected to a source of cooling fluid, for example, cooled water, through a suitable pumping device (not shown) in any known manner.

It will readily be seen that, because the vapor of any of the solvents which can be employed in the method of the present invention has a greater specific gravity than the air as shown in Table II, the solvent vapor tends to overflow the melting vessel when the front of the solvent vapor attains the level of the opening at the top of the vessel. The solvent vapor tending to overflow the melting vessel can advantageously condensed to form droplets in contact with the coiled cooling pipe 20, which droplets are recovered into the melting vessel as indicated by 21.

The refractory investment 11 with the pattern 10 removed away is then heated in a heating furnace at 850° C. for about 2 hours in a similar manner as practised in the conventional investment casting method, thereby to completely remove residues of the thermally fusible material which may be left unmelted within the investment 11 and which may otherwise constitute a cause of blowholes in the resultant casting and also to strengthen the investment 11.

The heat treated refractory investment 11 is now ready to be used as a mold of one-piece construction with the opening 11a serving as a sprue through which molten metal is poured into the mold.

Figure 3:
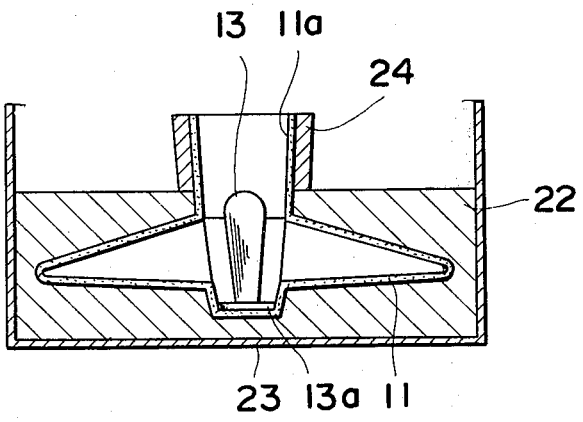
FIG. 3 is a side sectional view of the mold placed in a flask in readiness for casting of the screw propeller.

As shown in FIG. 3, the mold 11, which has been identified by the refractory coating or refractory investment in the foregoing description, is subsequently embedded in a mass of dry sand 22, such as steel shot, chromized sand, zircon sand or the like, which is filled in a suitable flask 23, so that the mold 11 can be backed-up by the mass of dry sand 22. At this time, only a portion of the mold 11 adjacent the sprue 11*a* is exposed outside the mass of dry sand 22 within the flask 23, which exposed portion of said mold 11 is in turn covered with a lagging material 24, which may be made of ceramic fiber, for the purpose of heat insulation.

The assembly of FIG. 3 is, prior to the molten metal being poured into the mold 11, heated to attain a predetermined temperature thereby to minimize the temperature difference between the mold 11 and the molten metal to be poured thereinto. By way of example, it may be heated to about 400° C. and, in order to achieve this, it may be heated for about 3 hours. It should be noted that the temperature of the heated mold 11 is maintained until pouring of the molten metal completes.

While the mold 11 assembled in the manner as shown in FIG. 3 is maintained at the predetermined temperature, the molten metal is poured into the mold 11 through the sprue 11*a*. Upon complete solidification of the molten metal, the mold 11 is removed away from the flask 23 and then broken, or otherwise sawed off, to provide the finally cast screw propeller. The core 13 can be easily removed from the finally cast screw propeller, for example, by giving an impact thereto or by applying an axially pushing force thereto.

Figure 4:
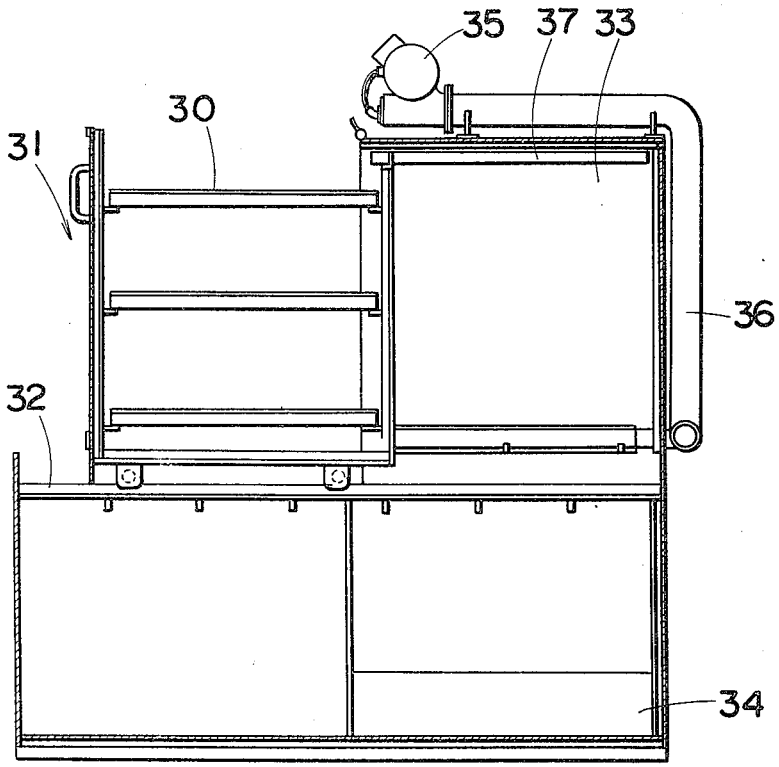
FIG. 4 is a schematic side sectional view of an oven which may be used to melt the thermally fusible pattern by heating it.
Figure 5:
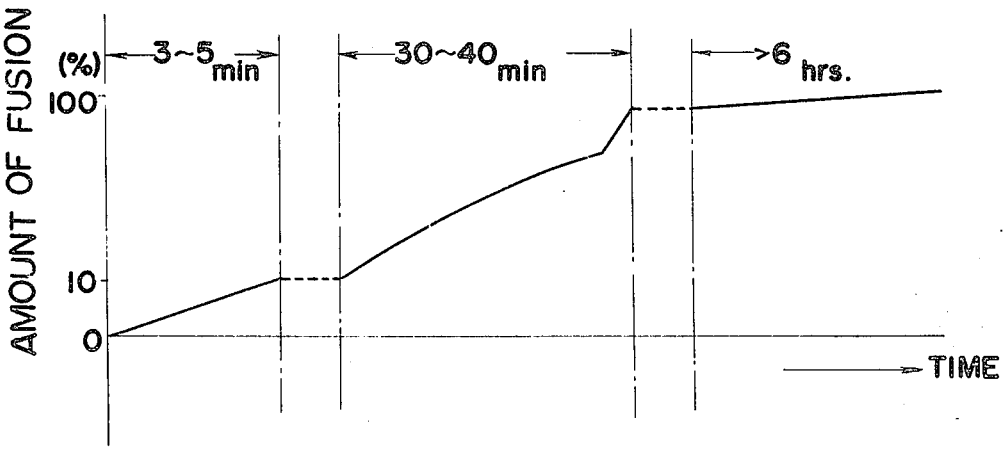
FIG. 5 is a schematic chart showing a process sequence for the manufacture of the mold of one-piece construction.

Referring now to FIGS. 4 and 5, the assembly consisting of the refractory investment 11 with the thermally fusible pattern 10 therein may, after a certain amount of the thermally fusible material for the pattern 10 has melted away in contact with the vaporized solvent and by the effect of latent heat of the solvent vapor leaving a clearance of a few milimeters between the surface of the pattern 10 and the inner surface of the refractory investment 11, the condition of which is substantially shown in FIG. 2, be subjected to a heat fusion process as hereinbefore described.

As can be understood with reference to the Table I, if the pattern 10 is prepared from a mixture of naphthalene and polystyrene resin, the thermal expansion coefficient thereof increases as compared with the pattern prepared from the naphthalene. This is particularly true where the polystyrene resin is employed in an amount not less than 1%. In general, melting the pattern 10 if the latter is made of the naphthalene added with the polystyrene resin in an amount not less than 1% may be carried out by immersing the assembly, that is, the pattern 10 with the investment 11 therearound, into a boiling water or by applying a blast of hot air of 350° to 450° C., without substantially accompanying formation of any crack in the resultant mold. However, immersion of the assembly into the boiling water would result in reduction of the mechanical strength of the resultant mold if the assembly is immersed for a substantially long period of time. On the other hand, application of the hot air blast would cause the pattern 10 to considerably expand and, therefore, this method of fusing the pattern cannot be applicable with the mold for casting of a relatively small product.

In order to render the pattern, which is made of naphthalene added with the polystyrene resin, to be used in making a mold of one-piece construction for casting a product having a relatively large size and a relatively complicated shape, formation of cracks which may otherwise occur in the resultant mold during melting of the pattern should be minimized or substantially avoided.

The heat fusion process to be subjected to the investment 11 with the pattern 10 therein after the certain amount of the thermally fusible material for the pattern 10 has melted away leaving the clearance between the pattern 10 and the investment 11 may be carried out by the use of an oven of a construction as shown in FIG. 4. It should be noted that the oven of FIG. 4 is shown as of a type capable of handling a plurality of investments 11 in one time.

The investment 11 with the substantially half-melted pattern 10 is placed on one of shelves 30 of a carriage 31 movable on a pair of parallel guide rails 32. The carriage 31 is then inserted into a heating chamber 33 situated immediately above a recovery container 34. Subsequently, a blast of hot air of a temperature sufficient to melt the pattern 10 within the investment 11 on one of the shelves of the carriage 31 is fed from a burner 35 into the heating chamber 33 through a duct 36 and in turn applied to the investment 11 with the pattern 10 therein from the bottom of the heating chamber 33. A melted portion of the pattern 10 falls downwards onto the recovery container 34.

The temperature of the hot air blast to be applied is preferably within the range of 350° to 450° C.

An exhaust gas generated within the heating chamber 33 can be emitted to the atmosphere through a grilled window at the tope of the heating chamber 33.

Referring particularly to FIG. 5, the period I represents a period during which the pattern 10 with the investment 11 therearound is melted in contact with the vaporized solvent and by the effect of latent heat of the solvent vapor, the period II represents a period during which the substantially half-melted pattern 10 is subjected to the heat fusion process within the oven of FIG. 4 and the period III represents a period during which a redisue of the material for the pattern 10 which may be left unremoved from the investment 11 during the heat fusion process is completely removed away from the investment 11 by placing the latter in an electric furnace under the temperature of 850° to 900° C.

It will be noted that the clearance formed between the pattern 10 and the investment 11 as hereinbefore described provides a space for accommodatng thermal expansion of the thermally fusible pattern 10 and, therefore, subsequent heating of the investment 11 with the pattern therein does not cause the resultant mold to crack.

With the mold of one-piece construction prepared by the method of the present invention, it has been found that the skin of a casting prepared from 18-8 stainless steel and that of prepared from 13-Cr stainless steel had respective surface smoothness of 15 to 20S. and 20 to 25S. and, therefore, no complicated machining process which is heretofore required may substantially be omitted.

Although the present invention has been fully described by way of example with reference to the accompanying drawings, it should be noted that various changes and modifications are apparent to those skilled in the art. By way of example, zircon may also be used as the refractory material for the slurry. In addition, so far as no formation of cracks is ensured, the thermally fusible pattern with the investment therearound may, when the thermally fusible material for the pattern is to be melted away from the investment, be subjected to any of the hot air blast, the vaporized solvent and the boiling water or a combination thereof.

Therefore, such changes and are to be understood as included within the scope of the present invention unless they depart therefrom.

What is claimed is:

1. An investment casting method for making a desired casting, which comprises:

the step of preparing a thermally fusible pattern from one member selected from the group consisting of naphthalene and p-dichlorobenzene, with or without the addition of a small amount up to about 10% by weight of a polymer having a vinyl radical, which thermally fusible pattern is substantially a replica of the desired casting, the step of forming a refractory investment casting enveloping the thermally fusible pattern by coating a refractory slurry around said thermally fusible pattern, the step of melting the thermally fusible pattern so as to leave the refractory investment having a cavity that has been occupied by said thermally fusible pattern, said cavity having all the details of said thermally fusible pattern, the step of heating said refractory investment within an oven to remove all the residue of the thermally fusible pattern out of said refractory investment and to provide a rigid ceramic mold of one-piece construction, the step of pouring molten metal into said mold while the latter is heated to minimize the temperature difference between said mold and said molten metal, the step of solidifying said molten metal within said mold, and the step of removing the solidified metal in the form of the desired casting out of said mold.

2. An investment casting method as claimed in claim 1, wherein said forming step is carried out by repeating a predetermined number of times a cycle consisting of dipping the thermally fusible pattern into a bath containing the refractory slurry and subjecting the coated pattern to a sanding process.

3. An investment casting method as claimed in claim 2, wherein said melting step is carried out by the use of an organic chlorinated hydrocarbon solvent, said melting of said thermally fusible pattern being achieved in contact with the vapor of said organic solvent and by the effect of latent heat evolved by the vaporized solvent.

4. An investment casting method as claimed in claim 3, further comprising the step of heating said investment with said pattern therein to melt the pattern out of said investment, said investment heating step being carried out in an oven under a temperature within the range of 350° to 450° C. after said thermally fusible pattern has been melted in an amount sufficient to form a clearance between the surface of said pattern and the inner surface of said investment.

5. An investment castng method as claimed in claim 3, wherein said chlorinated hydrocarbon is selected from the group consisting of 1, 1, 1-trichloroethane, 1,1,2-trichloroethane and 1,1,2,2-tetrachloroethane.

6. An investment casting method as claimed in claim 1, wherein said polymer is selected from the group consisting of a polystyrene resin, an ethylenevinyl acetate copolymer and a polyetylene resin.

7. A method according to claim 1 wherein the thermally fusible pattern is prepared from a mixture of naphthalene and a polystyrene resin, said polystyrene resin being present in an amount of 0.5 to 10% based on the weight of the naphthalene.

8. A method according to claim 1 wherein the thermally fusible pattern is prepared from a mixture of napthalene and an ethylene vinyl acetate copolymer, said copolymer being present in an amount of 1 to 5% based on the weight of the naphthalene.

9. A method according to claim 1 wherein the thermally fusible pattern is prepared from a mixture of naphthalene and a polyethylene resin, said polyethylene being present in an amount of 3 to 10%, based on the weight of the naphthalene.

10. A method according to claim 1, wherein the thermally fusible pattern is made solely of naphthalene.

11. A method according to claim 1, wherein the thermally fusible pattern is made solely of p-dichlorobenzene.

12. A refractory mold of one-piece construction which is manufactured by preparing a thermally fusible pattern from one member selected from the group consisting of naphthalene and p-dichlorobenzene, with or without the addition of a small amount up to about 10% by weight of a polymer having a vinyl radical, which thermally fusible pattern is a substantial replica of a desired casting to be made by the use of said mold, subsequently forming a refractory investment eveloping the thermally fusible pattern, melting the thermally fusible pattern so as to leave the refractory investment having a cavity that has been occupied by said thermally fusible pattern, said cavity having all the details of said thermally fusible pattern, and finally heating said refractory investment within an oven to remove all the residue of the thermally fusible pattern out of said refractory investment and to provide said rigid ceramic mold of one-piece construction.

13. A refractory mold according to claim 12, wherein the thermally fusible pattern is made solely of napthalene.

14. A refractory mold according to claim 12, wherein the thermally fusible pattern is made solely of p-dichlorobenzene.

15. A refractory mold according to claim 12, wherein wherein the thermally fusible pattern is prepared from a mixture of naphthalene and a polystyrene resin, said polystyrene resin being present in an amount of 0.5 to 10% based on the weight of the naphthalene.

16. A refractory mold according to claim 12, wherein the thermally fusible pattern is prepared from a mixture of naphthalene and an ethylene vinyl acetate copolymer, said copolymer being present in an amount of 1 to 5% based on the weight of the naphthalene.

17. A refractory mold according to claim 12, wherein the thermally fusible pattern is prepared from a mixture of naphthalene and a polyethylene resin, said polyethylene being present in an amount of 3 to 10% based on the weight of the naphthalene.

* * * * *